US008991210B1

(12) United States Patent
Stewart, Jr.

(10) Patent No.: US 8,991,210 B1
(45) Date of Patent: Mar. 31, 2015

(54) REVOLVING JEWELRY SYSTEM

(76) Inventor: Cary Stewart, Jr., Madison Heights, MI (US)

( * ) Notice: Subject to any disclaimer, the term of this patent is extended or adjusted under 35 U.S.C. 154(b) by 0 days.

(21) Appl. No.: 13/587,113

(22) Filed: Aug. 16, 2012

Related U.S. Application Data

(60) Provisional application No. 61/525,336, filed on Aug. 19, 2011.

(51) Int. Cl.
*A44C 7/00* (2006.01)

(52) U.S. Cl.
CPC . *A44C 7/003* (2013.01); *Y10S 63/90* (2013.01)
USPC ..... 63/12; 63/900

(58) Field of Classification Search
USPC ..... 63/29.2, 30, 31, 12, 13, 900; 24/303
See application file for complete search history.

(56) References Cited

U.S. PATENT DOCUMENTS

| | | | | | |
|---|---|---|---|---|---|
| 3,550,936 | A | * | 12/1970 | Puttick | 472/57 |
| 3,732,512 | A | * | 5/1973 | Puttick | 335/302 |
| 4,052,864 | A | * | 10/1977 | Hofsaess | 63/31 |
| 4,186,567 | A | | 2/1980 | Monden et al. | 63/14 |
| 4,841,746 | A | * | 6/1989 | Chen | 63/15 |
| 4,912,944 | A | | 4/1990 | Crosley et al. | 63/29.2 |
| 5,203,183 | A | * | 4/1993 | Salerno | 63/12 |
| 5,355,698 | A | | 10/1994 | Edmark | 63/29.1 |
| 6,594,871 | B2 | | 7/2003 | Hoffman | 24/303 |
| 7,216,508 | B2 | | 5/2007 | Kretchmer et al. | 63/35 |
| 7,329,020 | B1 | * | 2/2008 | Miller | 362/104 |
| 7,937,966 | B2 | | 5/2011 | Golove et al. | 63/40 |
| 2002/0112322 | A1 | | 8/2002 | Hoffman | 24/303 |
| 2004/0074259 | A1 | | 4/2004 | Hartgrove | 63/29.2 |
| 2005/0120743 | A1 | | 6/2005 | Pickering | 63/12 |
| 2006/0048543 | A1 | | 3/2006 | Kessler | 63/40 |
| 2006/0075781 | A1 | | 4/2006 | Kretchmer et al. | 63/5.1 |
| 2007/0084241 | A1 | * | 4/2007 | Kretchmer et al. | 63/29.2 |
| 2007/0180859 | A1 | | 8/2007 | Hwang | 63/12 |
| 2008/0016911 | A1 | | 1/2008 | Morgan | 63/12 |
| 2009/0100865 | A1 | | 4/2009 | Van Guelpen | 63/1.11 |
| 2009/0100869 | A1 | | 4/2009 | Golove et al. | 63/23 |
| 2010/0075073 | A1 | | 3/2010 | O'Byrne | 428/14 |
| 2010/0101274 | A1 | | 4/2010 | Worth | 63/40 |
| 2011/0080555 | A1 | | 4/2011 | Chow | 351/52 |

* cited by examiner

*Primary Examiner* — Jack W Lavinder
(74) *Attorney, Agent, or Firm* — Christopher P. Maiorana, PC

(57) ABSTRACT

An apparatus comprising a stud, a first magnet, a retaining portion, and a second magnet. The stud may be configured to have a diameter to pass through an earlobe. The first magnet may (i) be connected near a first end of the stud and (ii) have a first polarity. The retaining portion may (i) be connected to a middle portion of the stud and (ii) be configured to secure the earlobe to the first magnet. The second magnet may (i) be connected near a second end of the stud and (ii) have a similar polarity to said first polarity. The similar polarity may be configured to oppose the first polarity to allow the second magnet to spin in relation to an axis of the stud.

13 Claims, 3 Drawing Sheets

REVOLVING JEWELRY SYSTEM

This application claims the benefit of U.S. Provisional Application No. 61/525,336, filed Aug. 19, 2011, and is hereby incorporated by reference in its entirety.

FIELD OF THE INVENTION

The present invention relates to jewelry generally and, more particularly, to an automatic revolving jewelry system.

BACKGROUND OF THE INVENTION

Conventional jewelry tends to be fixed to a particular body part. Some conventional jewelry has a motor to help spin certain portions of the jewelry. However, such motors add to the cost and/or reliability of the jewelry. Motors usually run on a battery or other power supply which tends to wear out and need replacing.

It would be desirable to implement an automatic revolving jewelry system that may be implemented without a motor.

SUMMARY OF THE INVENTION

The present invention concerns an apparatus comprising a stud, a first magnet, a retaining portion, and a second magnet. The stud may be configured to have a diameter to pass through an earlobe. The first magnet may (i) be connected near a first end of the stud and (ii) have a first polarity. The retaining portion may (i) be connected to a middle portion of the stud and (ii) be configured to secure the earlobe to the first magnet. The second magnet may (i) be connected near a second end of the stud and (ii) have a similar polarity to said first polarity. The similar polarity may be configured to oppose the first polarity to allow the second magnet to spin in relation to an axis of the stud.

The objects, features and advantages of the present invention include providing a revolving jewelry that may (i) automatically rotate, (ii) use magnets to provide rotation without a motor (iii) be implemented in a consumer package and/or (iv) have a fixed ornament as the background while the forefront ornament revolves in a 360 degree rotation in either direction.

BRIEF DESCRIPTION OF THE DRAWINGS

These and other objects, features and advantages of the present invention will be apparent from the following detailed description and the appended claims and drawings in which:

DETAILED DESCRIPTION OF THE PREFERRED EMBODIMENTS

Figure 1:
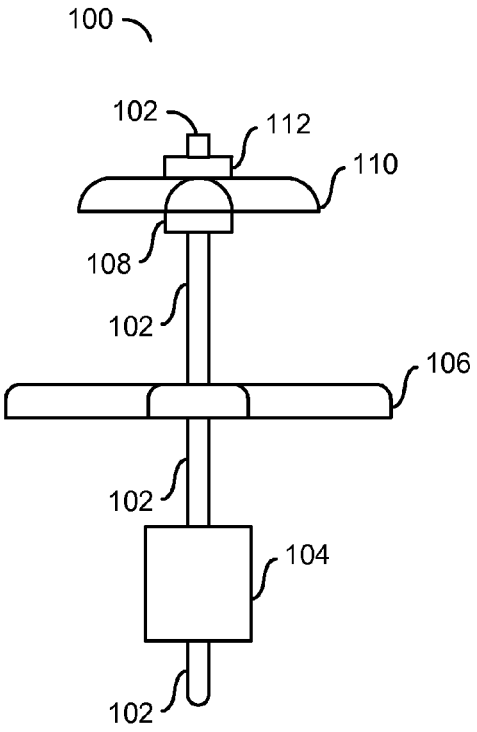
FIG. 1 is a top view of a jewelry piece in accordance with the present invention.

Referring to FIG. 1, a diagram of an apparatus 100 is shown in accordance with an embodiment of the present invention. In one example, the apparatus 100 may be implemented as an earring. In another example, the apparatus 100 may be implemented as another type of pierced jewelry. The apparatus 100 generally comprises a stud 102, a magnet 104, a securing portion 106, a magnet 108 and a portion 110 and a portion 112. The portion 110 may be implemented as an ornamental portion. The portion 112 may be implemented as a head/anchor. In one example, the stud 102 may be implemented as a post. The stud 102 may have a diameter sufficiently small to allow the stud to pass through a pierced earlobe. The stud 102 may have a diameter sufficiently large enough to provide a ridge support for the magnet 104, the security portion 106, the magnet 108 and/or the portion 110.

In one example, the magnet 104 may have a first polarity. In one example, the magnet 108 may have a polarity similar to the first polarity. The similar polarity is generally the same as the first polarity. By implementing the magnet 104 and/or the magnet 108 with similar polarities, a repulsion effect may occur between the magnet 104 and/or the magnet 108. The repulsion effect may be sufficient to allow the magnet 108 to spin about an axis of the stud 102. In general, the magnet 104 may be securely connected to the post 102. The magnet 104 may be configured to secure the post 102 to an ear of a user. The magnet 104 may clip on to the post 102. In one example, the magnet 104 may be on the inside of an earlobe, while the securing portion 106 may be on the outside of an earlobe (to be shown in more detail in connection with FIGS. 5 and 6). While an earlobe has been described, the apparatus 100 may be secured to a variety of body parts (e.g., nose, belly, etc.).

In general, the distance between the magnet 104 and the magnet 108 may be a close proximity distance (e.g., less than approximately 2½ cm). The proximity distance will normally be close enough to create a constant repelling force between the magnet 104 and the magnet 108. The magnet 108 is generally placed on the stud 102 with the anchor 112 limiting the movement to within the proximity distance. The magnet 108 will normally be forced to try to move past the proximity distance. The magnet 108 is normally secured to the portion 110. The portion 110 may be loosely attached to the stud 102. The repulsive force will push on the magnet 108 forcing a state of motion while trying to move past the proximity distance. The head/anchor 112 normally keeps the magnet 108 and/or the portion 110 from popping off the stud 102. The anchor 112 normally works against the repulsion force between the magnet 104 and the magnet 108.

In one example, the ornamental portion 110 may be configured as a single piece along with the magnet 108. For example, the magnet 108 may be formed having an ornamental design without the need for the piece 110 to be implemented separately.

In one example, the magnet 104 may be placed on the stud 102 behind an ear. The magnet 104 may act as the securing clamp to keep the apparatus 100 from falling from the stud 102. The magnet 104 may also provide the main focus for repulsion energy. By placing the magnet 104 on the stud 102 with the same polarity pointed at the opposing magnet 108, energy may be created to push the portion 110 around in circles. The magnet 108 and the portion 110 may be attached by securing with glue, welding, etc. By placing the magnet 108 on the stud 102 with an opposite polarity pointed at the opposing magnet 104, the spinning effect may be nullified greatly if not stopping the spin totally. The magnet 104 and the portion 106 may act as the leverage to hold the apparatus 100 in place.

The small parts (e.g., 102, 106, 110) may be manufactured, in one example, to be approximately ⅓ of the weight of the apparatus 100. However, the particular size of the ornamental portions 106 and/or 110 may be varied to depend upon the desires of the customer. In general, the apparatus 100 may be designed to be lightweight. In one example, the apparatus 100 may be no longer than approximately 2.5 cm (e.g., entire earring with all parts combined). The average length of the apparatus 100 may be about 2 cm. However, the particular length of the apparatus may be varied to meet the design criteria of a particular implementation.

The shaft 102 normally fits through a hole in the small parts (e.g., 106 and/or 110). Such a hole may allow the portions 106 and/or 110 to spin around the shaft 102 through the mechanics of spinning. In one example, the spinning may be started with a small push. In another example, the spinning may be started by a pin wheel effect (e.g., by wind pressure). The holes implemented in the portions 106 and/or 110 may be a low friction design to encourage spinning. The apparatus 100 may be designed to be worn for any event (e.g., formal or non-formal, recreational or leisure, etc.). The apparatus 100 may be used on different jewelry categories as well, (e.g., pendants, necklaces, hair design, clothing design, etc.).

Figure 2:
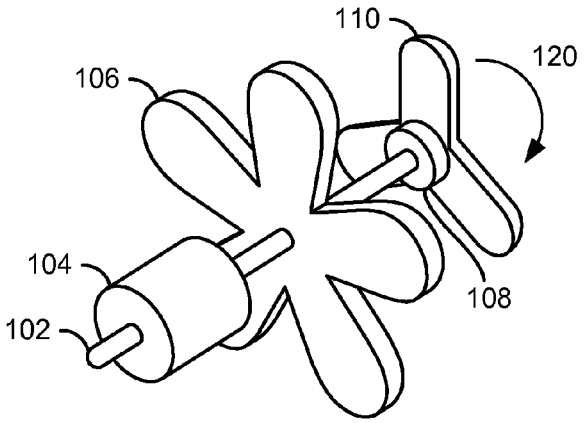
FIG. 2 is a perspective view of the jewelry of FIG. 1.

Referring to FIG. 2, a perspective view of the apparatus 100 is shown. The apparatus 100 includes an arrow 120. The arrow 120 illustrates a direction the portion 110 rotates about the stud 100. In one example, a bearing may be implemented between the portions 106 and/or 110 to decrease friction with the stud 102. Such a bearing may be made of plastic, Mylar, etc. The particular material used to implement the bearing may be varied to meet the design criteria of a particular implementation.

Figure 3:
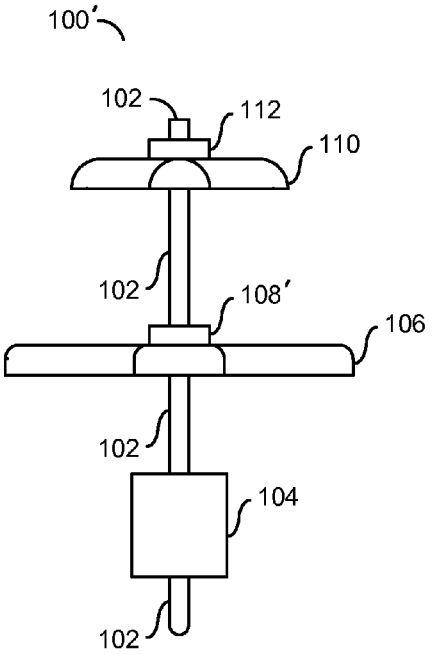
FIG. 3 is a top view of an alternate embodiment of the present invention.

Referring to FIG. 3, an apparatus 100' illustrating an alternate embodiment is shown. The apparatus 100' shows the second magnet 108' adjacent to the retaining portion 106. The magnet 108' may spin with respect to the magnet 104. The magnet 108' may cause the portion 106 to spin.

Figure 4:
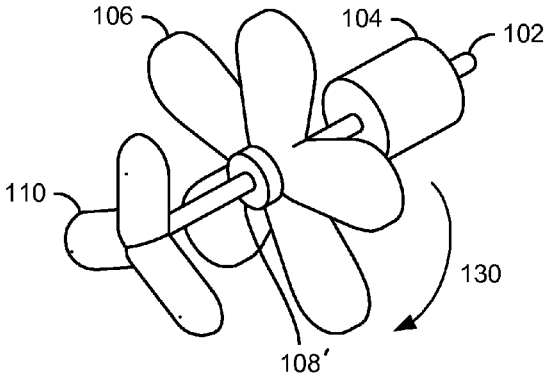
FIG. 4 is a perspective view of the alternate embodiment.

Referring to FIG. 4, a perspective view of the alternate embodiment is shown. The apparatus 100' includes an arrow 130. The arrow 130 illustrates a direction of travel the portion 106 is configured to rotate. The apparatus 100' may be configured to cause the portion 106 to rotate in the opposite direction.

Figure 5:
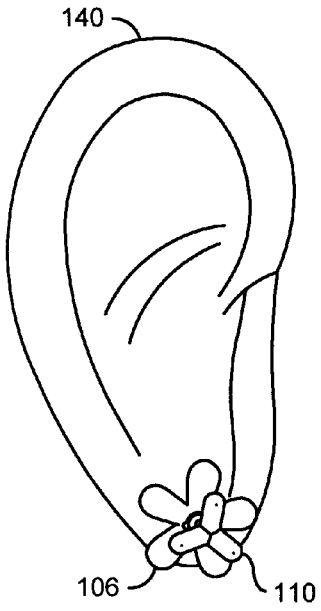
FIG. 5 is a diagram illustrating the present invention in the context of an ear.

Referring to FIG. 5, a perspective view of the apparatus 100 is shown. The apparatus 100 is shown connected to an ear 140. While an ear 140 is shown, other body parts may hold the apparatus 100.

Figure 6:
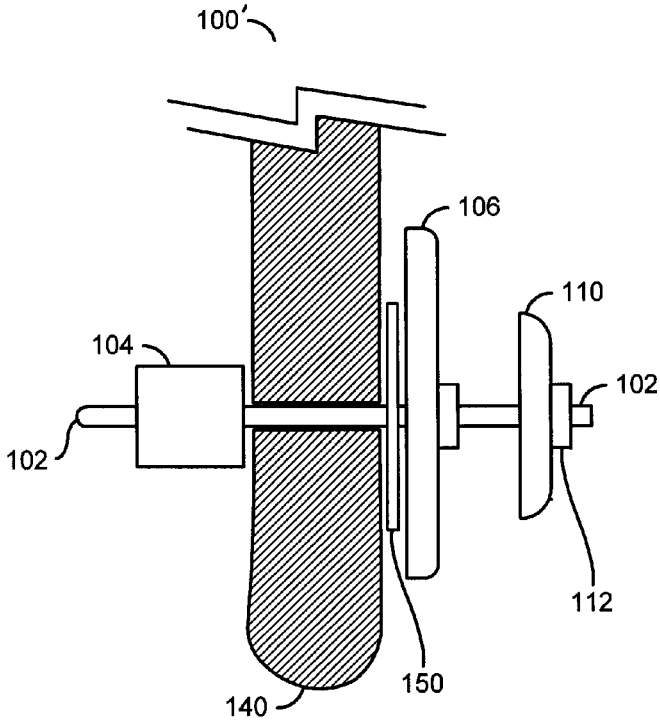
FIG. 6 is an enlarged view of the invention in the context of an earlobe.

Referring to FIG. 6, an enlarged view of the apparatus 100' is shown. The apparatus 100' is shown having a bearing 150. The bearing 150 may be configured to allow the portion 106 to spin about the stud 102 without binding on the ear 140.

The apparatus 100 may be made using three manufacturing steps. The jewelry parts (e.g., the ornaments 106 and/or 110 and earring parts 102) may be manufactured in one process. The magnets 104 and 108 may be manufactured in another process. The small parts may be manufactured using a third process (e.g., the small parts that are attached to the end of the earring stud 102 that allow the ornament to swivel). The apparatus 100 may be a combination of all the small parts to make an earring.

While the invention has been particularly shown and described with reference to the preferred embodiments thereof, it will be understood by those skilled in the art that various changes in form and details may be made without departing from the scope of the invention.

The invention claimed is:

1. An apparatus comprising:

a stud configured to have a diameter to pass through an earlobe;

a first magnet (i) connected near a first end of said stud, (ii) having a first polarity and (iii) positioned on a first side of an earlobe;

a retaining portion (i) connected to a middle portion of said stud and (ii) configured to secure to a second side of an earlobe than said first magnet; and a second magnet (i) connected near a second end of said stud and (ii) having a similar polarity to said first polarity, said similar polarity configured to oppose said first polarity to allow said second magnet to spin in relation to an axis of said stud, wherein said retaining portion is connected to said stud in an area between said first magnet and said second magnet.

2. The apparatus according to claim 1, wherein said second magnet is configured to have a hole that encloses said stud and allows said second magnet to spin about said stud.

3. The apparatus according to claim 1, wherein an ornamental portion (i) is connected to said second magnet and (ii) configured to spin along with said second magnet.

4. The apparatus according to claim 1, wherein said second magnet is configured to have an ornamental appearance.

5. The apparatus according to claim 1, wherein said second magnet (i) is connected to said retaining portion and (ii) configured to spin along with said retaining portion.

6. The apparatus according to claim 1, wherein a bushing is connected between said second magnet and said stud.

7. The apparatus according to claim 1, further comprising an anchor connected to said second end of said stud, said anchor configured to hold said second magnet onto said stud by working against a force between said first magnet and said second magnet.

8. An apparatus comprising:

a stud configured to have a diameter to pass through an earlobe;

a first magnet (i) connected near a first end of said stud, (ii) having a first polarity and (iii) positioned on a first side of an earlobe;

a retaining portion (i) connected to a middle portion of said stud and (ii) configured to secure to a second side of an earlobe than said first magnet; and a second magnet (i) connected near a second end of said stud and (ii) having a similar polarity to said first polarity, said similar polarity configured to oppose said first polarity to allow said second magnet to spin in relation to an axis of said stud, wherein said second magnet (i) is connected to said retaining portion and (ii) configured to spin along with said retaining portion.

9. The apparatus according to claim 8, wherein said second magnet is configured to have a hole that encloses said stud and allows said second magnet to spin about said stud.

10. The apparatus according to claim 8, wherein an ornamental portion (i) is connected to said second magnet and (ii) configured to spin along with said second magnet.

11. The apparatus according to claim 8, wherein said second magnet is configured to have an ornamental appearance.

12. The apparatus according to claim 8, wherein a bushing is connected between said second magnet and said stud.

13. The apparatus according to claim 8, further comprising an anchor connected to said second end of said stud, said anchor configured to hold said second magnet onto said stud by working against a force between said first magnet and said second magnet.

* * * * *